US009797418B2

(12) United States Patent
Hashimoto et al.

(10) Patent No.: US 9,797,418 B2
(45) Date of Patent: Oct. 24, 2017

(54) HYDRAULIC DEVICE AND PRIME MOVER DEVICE

(71) Applicant: MITSUBISHI HITACHI POWER SYSTEMS, LTD., Kanagawa (JP)

(72) Inventors: Tetsuya Hashimoto, Tokyo (JP); Yasuhiko Okuda, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 150 days.

(21) Appl. No.: 14/770,162

(22) PCT Filed: Aug. 27, 2013

(86) PCT No.: PCT/JP2013/072863
§ 371 (c)(1),
(2) Date: Aug. 25, 2015

(87) PCT Pub. No.: WO2014/155767
PCT Pub. Date: Oct. 2, 2014

(65) Prior Publication Data

US 2016/0010669 A1 Jan. 14, 2016

(30) Foreign Application Priority Data

Mar. 28, 2013 (JP) ..... 2013-069515

(51) Int. Cl.
*F15B 21/04* (2006.01)
*F15B 11/08* (2006.01)
*F15B 13/02* (2006.01)

(52) U.S. Cl.
CPC ..... *F15B 21/041* (2013.01); *F15B 11/08* (2013.01); *F15B 13/025* (2013.01);
(Continued)

(58) Field of Classification Search
CPC ..... F15B 21/041
(Continued)

(56) References Cited

U.S. PATENT DOCUMENTS 6,814,409 B2 * 11/2004 Jackson ..... A61G 15/02 297/330
7,845,896 B2 * 12/2010 Bitter ..... B66F 9/22 414/699

FOREIGN PATENT DOCUMENTS

CN 2898092 5/2007
CN 101983835 3/2011
(Continued)

OTHER PUBLICATIONS

Notice of Preliminary Rejection dated Oct. 13, 2016 in corresponding Korean Application No. 10-2015-7022379, with English translation.
(Continued)

*Primary Examiner* — Thomas E Lazo
(74) *Attorney, Agent, or Firm* — Wenderoth, Lind & Ponack, L.L.P.

(57) ABSTRACT

An object of the present invention is to prevent breakage of a unidirectional filter part for high-pressure oil. A hydraulic device 100 supplies oil to a high-pressure oil channel L1 and a low-pressure oil channel L2 from an oil tank 102 via a supply pump 104. The hydraulic device 100 includes an accumulator 106 capable of accumulating a hydraulic pressure of the oil supplied to the high-pressure oil channel from the supply pump; a filter part 120 disposed between the supply pump and a connection point N1 at which the high-pressure oil channel connects to the accumulator, along a direction in which the oil is supplied; and a check valve
(Continued)

110 capable of preventing a backflow of the oil to the filter part, and disposed between the filter part and the connection point.

4 Claims, 3 Drawing Sheets

(52) U.S. Cl.
CPC ..... *F15B 2211/20576* (2013.01); *F15B 2211/30505* (2013.01); *F15B 2211/611* (2013.01); *F15B 2211/615* (2013.01); *F15B 2211/625* (2013.01); *F15B 2211/865* (2013.01); *F15B 2211/8757* (2013.01)

(58) Field of Classification Search
USPC ..... 60/453, 459
See application file for complete search history.

(56) References Cited

FOREIGN PATENT DOCUMENTS

| | | | |
|---|---|---|---|
| CN | 102032121 | 4/2011 | |
| CN | 202733127 | 2/2013 | |
| CN | 102962232 | 3/2013 | |
| EP | 1 353 076 | 10/2003 | |
| JP | 50-145778 | 11/1975 | |
| JP | 56-37701 | 4/1981 | |
| JP | 63-171703 | 11/1988 | |
| JP | 3-128406 | 12/1991 | |
| JP | 9-122999 | 5/1997 | |
| JP | 10-54215 | 2/1998 | |
| JP | 10-328507 | 12/1998 | |
| JP | 2004-156537 | 6/2004 | |
| JP | 2004-346769 | 12/2004 | |
| JP | 2005-172112 | 6/2005 | |
| JP | 2012-229802 | 11/2012 | |
| KR | 10-0186911 | 3/1999 | |
| WO | 2010/020376 | 2/2010 | |
| WO | WO 2010020376 A1 * | 2/2010 | ..... F15B 11/00 |

OTHER PUBLICATIONS

International Search Report dated Sep. 24, 2013 in corresponding International Application No. PCT/JP2013/072863.
Written Opinion of the International Searching Authority dated Sep. 24, 2013 in corresponding International Application No. PCT/JP2013/072863.
Extended European Search Report dated Oct. 20, 2016 in corresponding European Application No. 13880140.2.
First Office Action dated Apr. 13, 2016 in corresponding Chinese Application No. 201380073150.9 (with English translation).
Office Action dated Dec. 9, 2016 in corresponding Japanese Application No. 2013-069515 (with English translation).

* cited by examiner

HYDRAULIC DEVICE AND PRIME MOVER DEVICE

TECHNICAL FIELD

The present invention relates to a hydraulic device capable of supplying oil to both of a high-pressure oil channel and a low-pressure oil channel from a common supply pump, and a prime mover device having the hydraulic device.

BACKGROUND

Among servomotors and control devices used in various prime movers such as a gas turbine and a steam turbine, some of the known types are hydraulically controlled. A hydraulic device used for the hydraulic control includes a low-pressure oil channel for supplying low-pressure oil which is to be used as lubricant oil for a bearing or the like of a turbine and a high-pressure oil channel for supplying high-pressure oil which is to be used in the hydraulic control of a servomotor, a control device, or the like. As such a hydraulic device, Patent Literature 1 discloses a hydraulic device which is capable of supplying oil discharged from a supply pump to a high-pressure oil channel, as well as accumulating pressure of the high-pressure oil channel in an accumulator when, for instance, the supply pump is stopped.

CITATION LIST

Patent Literature

Patent Literature 1: JP 2004-156537A

SUMMARY

Problems to be Solved

When oil is supplied from a tank via a supply pump to a high-pressure oil channel which is a system of high-pressure oil supplied to a control device, it is necessary to remove impure substances such as dust to prevent the high-pressure oil channel from being clogged with the impure substances to cause deterioration of the performance of the hydraulic control. Thus, as illustrated in FIG. 3, a unidirectional filter part 16 having a filtering performance in direction A1 in which high-pressure oil is supplied is disposed at the input-stage side of a high-pressure oil channel 14 of a hydraulic device 10. Here, as illustrated in FIG. 3, in the hydraulic device 10 having two systems of the high-pressure oil channel 14 and a low-pressure oil channel 20, an accumulator 18 is disposed at the downstream side of the filter part 16. Thus, when the supply pump 12 is stopped, the accumulator 18 starts operating and oil flows through the high-pressure oil channel 14, and the oil also flows in a direction of the low-pressure oil channel 20 (direction B1 in FIG. 3), the flow of the oil here being opposite to the normal flow direction of the oil. As a result, a counter pressure is applied to the filter part 16, which may result in breakage of a filter element having a mesh shape included in the filter part 16.

Patent Literature 1 discloses a hydraulic device capable of supplying oil discharged from an oil supply pump to a high-pressure oil channel, and accumulating pressure of the high-pressure oil channel in an accumulator. However, Patent Literature 1 does not mention prevention of breakage of a unidirectional filter part for high-pressure oil in a configuration including two systems of a high-pressure oil channel and a low-pressure oil channel as illustrated in FIG. 3.

The present invention was made in view of the above problem. An object of the invention is to provide a novel and improved hydraulic device capable of preventing breakage of a filter part for high-pressure oil, and a prime mover device including the hydraulic device.

Solution to the Problems

An aspect of the present invention is a hydraulic device configured to supply oil to a high-pressure oil channel and a low-pressure oil channel from an oil tank via a supply pump. The hydraulic device includes: an accumulator capable of accumulating a hydraulic pressure of the oil supplied to the high-pressure oil channel from the supply pump; a filter part disposed between the supply pump and a connection point at which the high-pressure oil channel connects to the accumulator, along a direction in which the oil is supplied; and a check valve capable of preventing a backflow of the oil to the filter part, and disposed between the filter part and the connection point.

According to one aspect of the present invention, since the check valve capable of preventing a backflow of the oil to the filter part is disposed between the filter part and the connection point at which the high-pressure oil channel connects to the accumulator, it is possible to prevent the oil from flowing backward toward the filter part to damage the filter part when, for instance, the supply pump is stopped.

In this case, in one aspect of the present invention, the filter part may include: an introduction part for introducing the oil supplied from the supply pump; a filter element having a mesh shape capable of filtering the oil introduced from the introduction part; a filter core part which is formed from a hard material in a substantially cylindrical shape and which includes a wall surface surrounded by the filter element, the wall surface including filter pores larger in size than mesh openings of the filter element; and a discharge part connected to an inside of the filter core part, the discharge part being capable of discharging the oil filtered by the filter element.

In this way, it is possible to prevent the oil from flowing backward toward the filter part to damage the filter element of the filter part when, for instance, the supply pump is stopped.

Further, in one aspect of the present invention, the high-pressure oil channel may include a high-pressure-side relief valve configured to be opened if a hydraulic pressure of the high-pressure oil channel is a predetermined value or more. The low-pressure oil channel may include a low-pressure-side relief valve configured to be opened if a hydraulic pressure of the low-pressure oil channel is a predetermined value or more. Further, a relief side of each of the high-pressure-side relief valve and the low-pressure-side relief valve may be connected to the oil tank.

Thus, it is possible to prevent breakage of the filter part by stopping a backflow toward the filter part for a hydraulic device capable of supplying oil to the high-pressure oil channel and the low-pressure oil channel with the common oil tank and supply pump.

Further, in another aspect of the present invention, a prime mover device includes a control device including the hydraulic device according to any one of the above.

According to the other aspect of the present invention, breakage of the unidirectional filter part for high-pressure oil is prevented, which improves the reliability of the control device equipped with the hydraulic device.

Advantageous Effects

As described above, according to the present invention, breakage of the unidirectional filter part for high-pressure oil is prevented. Thus, reliability of the control device equipped with the hydraulic device is improved.

DETAILED DESCRIPTION

A preferred embodiment of the present invention will now be described in detail. It is intended, however, that the following embodiment does not unduly limit the present invention described in the claims, and not all configurations described in the embodiment are necessarily required as a solution of the present invention.

Figure 1:
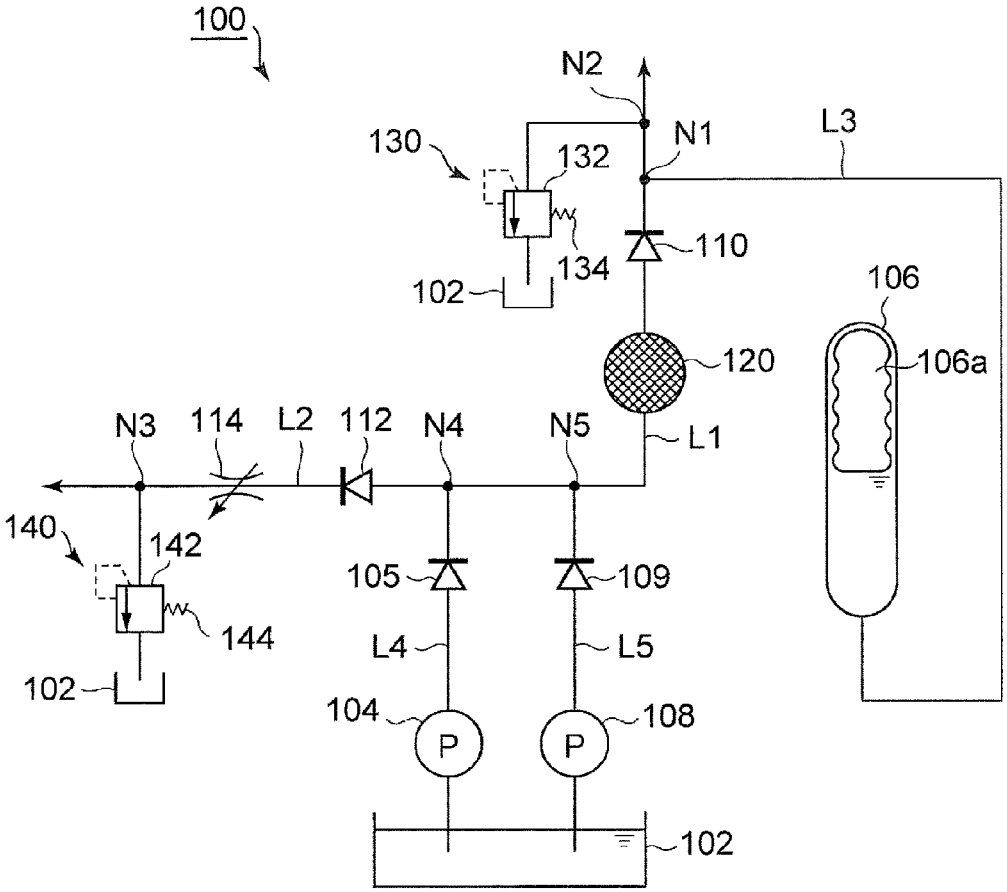
FIG. 1 is a schematic configuration diagram of one embodiment of a hydraulic device according to the present invention.

First, a configuration of the hydraulic device according to one embodiment of the present invention will be described with reference to the drawings. FIG. 1 is a schematic configuration diagram of one embodiment of a hydraulic device according to the present invention.

A hydraulic device 100 of the present embodiment is a hydraulic device capable of supplying oil to a high-pressure oil channel L1 and a low-pressure oil channel L2 with a common oil tank 102 and a common supply pump 104. In the present embodiment, the hydraulic device 100 includes a high-pressure oil channel L1 and a low-pressure oil channel L2, as well as a check valve 110 for stopping a backflow toward a filter part 120 disposed in the high-pressure oil channel L1 to prevent breakage of the filter part 120.

The hydraulic device 100 supplies high-pressure oil having a hydraulic pressure of approximately 10 kg/cm2 as working oil for hydraulically controlling a device that is hydraulically controlled, which is a servomotor or a control device used in various prime movers (prime mover devices) such as a gas turbine and a steam turbine. Specifically, high-pressure oil is supplied to the high-pressure oil channel L1 (high-pressure oil system) which supplies high-pressure oil being working oil used in hydraulic control of a servomotor, a control device or the like from the oil tank 102 by the supply pump 104, via an oil channel L4 including a check valve 105. The check valve 105 is a one-way valve that opens when pressurized oil flows from the supply pump 104 toward the oil channel L1 and that closes so as to prevent a flow of pressurized oil that is opposite to the flow toward the oil channel L1.

Further, in the present embodiment, an auxiliary pump 108 that serves as a backup pump in case of a malfunction or the like of the supply pump 104 is provided. The auxiliary pump 108 makes it possible to supply the high-pressure oil to the high-pressure oil channel L1 (high-pressure oil system) from the oil tank 102 via an oil channel L5 including a check valve 109, as a backup pump for the supply pump 104 being a main oil pump in case of a malfunction of the supply pump 104.

An accumulator 106 capable of accumulating hydraulic pressure of oil supplied from the supply pump 102 is connected to the high-pressure oil channel L1. As conventionally known, the accumulator 106 includes an accumulating chamber and a back-pressure chamber divided by a piston or an elastic expanding member so as to be fluid-tight. The accumulator 106 is configured such that the capacity of the accumulating chamber increases as a result of movement of the piston or expansion of the elastic expanding member when the pressure in the accumulating chamber exceeds the pressure in the back-pressure chamber, so as to accumulate hydraulic pressure in the accumulating chamber. In this way, it is possible to adjust the set minimum pressure at which pressure begins to be accumulated in the accumulating chamber by controlling the pressure of the back-pressure chamber. In the present embodiment, the accumulator 106 is capable of accumulating hydraulic pressure of approximately 8 kg/cm2.

Further, a high-pressure-side relief valve 130 is disposed in the high-pressure oil channel L1 as illustrated in FIG. 1. The high-pressure-side relief valve 130 is opened when the hydraulic pressure of the high-pressure oil channel L1 reaches a predetermined value or more. The high-pressure-side relief valve 130 includes a valve body 132 that opens and closes a port similarly to a conventionally known valve body, and a spring 134 that applies a force to press the valve body 132 against a valve seat (not illustrated).

Specifically, the high-pressure-side relief valve 130 is configured such that the valve body 132 is pressed against the valve seat so as to close the port when the hydraulic pressure of the high-pressure oil channel L1 is less than a predetermined pressure, and such that the valve body 132 moves against the force of the spring 134 so as to open the port when the hydraulic pressure of the high-pressure oil channel L1 is not less than the predetermined pressure, so that the pressurized oil in the high-pressure oil channel L1 is drained to the oil tank 102. Thus, with the function of the high-pressure-side relief valve 130, it is possible to prevent the hydraulic pressure of the high-pressure oil channel L1 from becoming the predetermined pressure set in advance or more. In the present embodiment, the high-pressure-side relief valve 130 is set so that the hydraulic pressure of the high-pressure oil channel L1 does not reach 10 kg/cm2 or more.

Besides the high-pressure oil channel L1 (high-pressure oil system) for supplying high-pressure oil which is to be used in the hydraulic control of a servomotor, a control device or the like, the hydraulic device 100 includes the low-pressure oil channel L2 (bearing oil system) for supplying low-pressure oil which is to be used as lubricant oil for a bearing of a turbine or the like. Specifically, low-pressure oil is supplied to the low-pressure oil channel L2 by the supply pump 104 from the oil tank 102 via the oil channel L4 including the check valve 105.

The low-pressure oil channel L2 includes a check valve 112 at the entry side which is a one-way valve that opens when oil flows from the supply pump 104 toward the low-pressure oil channel L2 and that closes so as to prevent a flow of pressurized oil that is opposite to the flow toward the low-pressure oil channel L2. Further, at the exit side of the check valve 112 of the low-pressure oil channel L2, a hydraulic-pressure adjustment valve 114 for adjusting the hydraulic pressure of the oil to be a predetermined pressure or less is disposed. In the present embodiment, the hydraulic-pressure adjustment valve 114 adjusts the hydraulic pressure of the low-pressure oil channel L2 to 1.2 kg/cm2.

Further, a low-pressure-side relief vale 140 is disposed in the low-pressure oil channel L2, as illustrated in FIG. 1. The low-pressure-side relief valve 140 is opened when the hydraulic pressure of the low-pressure oil channel L2 reaches a predetermined value or more. The low-pressure-side relief valve 140 includes a valve body 142 that opens and closes a port similarly to a conventionally known valve body, and a spring 144 which applies a force to press the valve body 142 against a valve seat (not illustrated). In the present embodiment, the low-pressure-side relief valve 140 is set so that the hydraulic pressure of the low-pressure oil channel L2 does not exceed 1.2 kg/cm2, and configured such that the valve body 142 moves against the force of the spring 144 so as to open the port when the hydraulic pressure of the low-pressure oil channel L2 reaches 1.2 kg/cm2 or more, so that the pressurized oil in the low-pressure oil channel L2 is drained to the oil tank 102.

Further, in the present embodiment, the high-pressure oil channel L1 includes a filter part 120 for filtering out impure substances such as dust at the entry side of the high-pressure oil channel L1 for the purpose of removing impure substances when oil is supplied from the oil tank 102 by the supply pump 104. The filter part 120 is a unidirectional filter device disposed between the supply pump 104 and a connection point N1 at which the high-pressure oil channel L1 connects to the accumulator 106. The filter part 120 has a filtering function in the direction in which oil is supplied to the high-pressure oil channel L1. The configuration of the filter part 120 will be described below in detail.

Further, in the present embodiment, a check valve 110 capable of preventing a backflow of oil to the filter part 120 is disposed between the filter part 120 and the connection point at which the accumulator 106 connects to the high-pressure oil channel L1. Specifically, the high-pressure oil is prevented from flowing backward in a direction opposite to the forward direction from the supply pump 104 toward the high-pressure oil channel L1, so that breakage of the filter part 120 is prevented.

In the present embodiment, the auxiliary pump 108 which serves as a backup pump in case of a malfunction of the supply pump 104 being a main oil pump is also provided. The hydraulic device 100 of the present embodiment is capable of supplying oil discharged from the supply pump 104 to both of the high-pressure oil channel L1 and the low-pressure oil channel L2, and includes the accumulator 106 capable of accumulating pressure of the high-pressure oil channel L1 when the supply pump 104 is stopped, for instance.

Further, as there is a risk that a bladder 106*a* of a rubber-balloon shape in the accumulator 106 gets damaged by a foreign matter contained in the oil discharged from the supply pump 104, the filter part (high-pressure oil filter) 120 needs to be disposed between the supply pump 104 and the accumulator 106. While the high-pressure oil discharged from the supply pump 104 being a main oil pump is used in the high-pressure oil system L1 and the bearing-oil system L2, for instance, the high-pressure oil system L1 has a pressure of 0 kg/cm2, and the bearing-oil system L2 has a pressure of 1.2 kg/cm2.

Thus, in a case where no check valve 110 is disposed at the downstream side of the filter part 120, there is a risk that the accumulator 106 starts operating to prevent a decrease in the high-pressure oil pressure when the supply pump 104 is switched to or from the auxiliary pump 108, which may cause the oil to flow not only to the high-pressure oil system L1 from the connection point N1 but also toward the low-pressure oil channel L2 from the high-pressure oil system L1 via the check valve 112 (backflow), thereby damaging the filter part having a unidirectional filtering function. In view of this, the check valve 110 is disposed on the outlet side of the filter part 120 serving as a high-pressure oil filter in order to stop a backflow of oil toward the low-pressure oil channel L2 from the high-pressure oil system L1 to prevent breakage of the filter part 120.

Further, as in the present embodiment, with regard to the hydraulic device 100 capable of supplying oil to the high-pressure oil channel L1 and the low-pressure oil channel L2 with the common oil tank 102 and the common supply pump 104, there is a risk that oil flows backward in a direction opposite to the forward direction in which the filter part 120 has a filtering performance when, for instance, the supply pump 104 is stopped, as described above. Thus, the check valve 110 is disposed at the downstream side of the filter part 120 disposed in the high-pressure oil channel L1 to stop a backflow toward the filter part 120, thereby preventing breakage of the filter part.

Figure 2A:
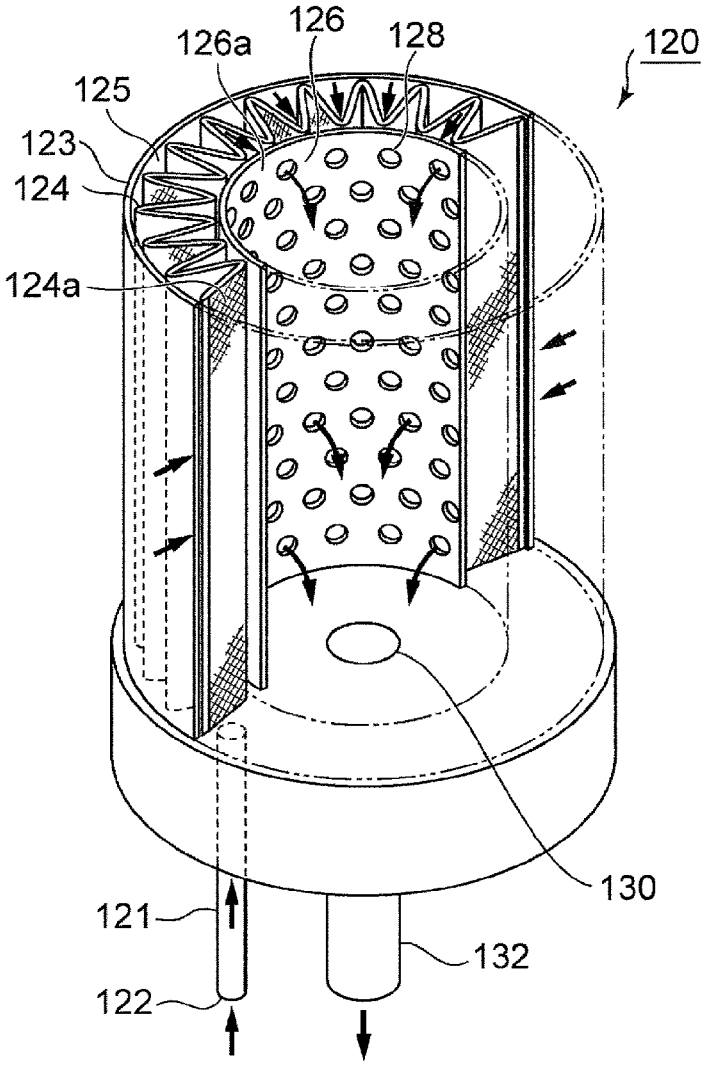
FIGS. 2A and 2B are schematic configuration diagrams of a filter part included in one embodiment of a hydraulic device according to the present invention.
Figure 2B:
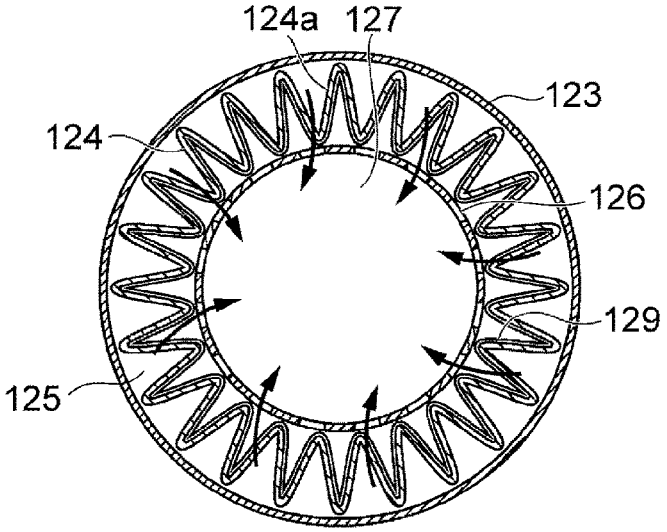
Figure 3:
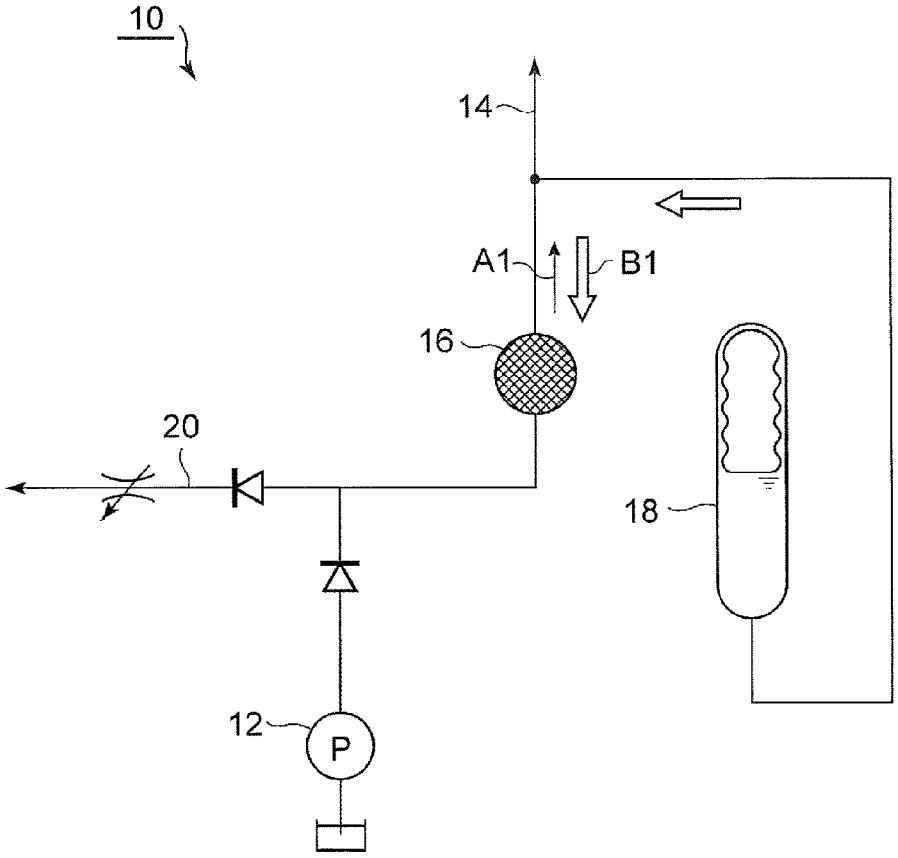
FIG.3 PRIOR ART
FIG. 3 is a schematic configuration diagram of one embodiment of a conventional hydraulic device.

Next, the configuration of the filter part included in the hydraulic device according to one embodiment of the present invention will be described with reference to the drawings. FIGS. 2A and 2B are schematic configuration diagrams of the filter part included in the hydraulic device according to one embodiment of the present invention.

As illustrated in FIG. 2A, the filter part 120 included in the hydraulic device 100 of the present embodiment includes a filter element 124 having a fine mesh shape and a filter core part 126, both disposed within a casing 123 having a substantially cylindrical shape.

The filter element 124 is formed of soft non-woven fabric or the like having fine mesh openings 124*a* of approximately 0.025 micron. As illustrated in FIG. 2A, the filter element 124 is disposed so as to cover the periphery of the filter core part 126 in a zigzag fashion, for the purpose of increasing the density of the filtering function. Further, as illustrated in FIG. 2B, the filter element 124 includes a support part 129 of a mesh shape formed from a hard material such as plastic that supports the filter element 124 disposed inside the support part 129.

Furthermore, the filter core part 126 is a substantially cylindrical member formed from a hard material such as metal, including aluminum, stainless steel and a sintered material. A plurality of filter pores 128 larger in size than the mesh openings 124*a* of the filter element 124 is formed on a wall surface 126*a* of the filter core part 126. Specifically, the filter part 120 is a device having a unidirectional filtering performance from outside to inside, and including the filter element 124 of a mesh shape mounted to the outer side of the filter core part 126 on which the less-fine filter pores 128 are formed.

With the filter part 120 having the above configuration, high-pressure oil introduced from an introduction inlet 122 of an introduction part 121 for high-pressure oil is introduced through a clearance part 125 between the casing 123 and the filter element 124. In this way, as illustrated in FIGS. 2A and 2B, the high-pressure oil is filtered from the filter element 124 disposed at the outer side toward the filter core part 126 disposed at the inner side. Further, when the filtering is performed in the forward direction, the soft filter element 124 is supported by the support part 129, so that the filter element 124 does not get damaged, for instance, by being stretched.

Further, the inside of the filter core part 126 becomes an oil channel 127, and a discharge part 130 capable of discharging oil filtered by the filter element 124 is disposed at the lower part of the oil channel 127, so that the filtered oil is discharged to the high-pressure oil channel L1 via a discharge pipe 132. Specifically, in the present embodiment, the filter part 120 is a unidirectional filter device that has a filtering function from the outside of the filter element 124 toward the inside of the filter core part 126.

In case high-pressure oil flows backward into the filter part 120 having the above configuration, i.e., in case high-pressure oil flows from the inside of the filter core part 126 to the outside of the filter element 124, there is a risk that the filter element 124 formed of a soft material contracted in a zigzag shape expands to be torn apart. Further, even if the filter element 124 does not go as far as getting damaged, the filter element 124 may be expanded like a balloon until the mesh openings 124*a* of the filter element 124 get enlarged, which deteriorates the filtering performance from then on.

In view of this, in the present embodiment, to prevent breakage or functional deterioration of the filter part 120 having a unidirectional filtering function with the above configuration, the check valve 110 is disposed at the downstream side of the filter part 120 so as to be capable of preventing a backflow toward the filter part 120. In this way, providing the check valve 110 to prevent breakage and functional deterioration of the filter element 124 of the filter part 120 makes it possible to maintain the filtering function of the filter part 120 at the high-pressure oil side. Further, it is possible to improve the reliability of a plant that includes a prime mover having a servomotor, a control device or the like by preventing a foreign matter from entering the control device or the like.

The embodiment of the present invention has been described in detail above, but the present invention is not limited thereto, and one skilled in the art would readily understand that various modifications may be implemented within a scope that does not substantially depart from the novel features and advantageous effects of the present invention. Thus, such modifications are all included in the scope of the present invention.

For instance, if a term is described along with another term that has a wider or similar meaning at least once in the present specification or drawings, the term can be paraphrased by the other term at any part of the specification or the drawings. Further, the configuration and operation of the hydraulic device are not limited to those described in the embodiment of the present invention, and may be modified in various ways when implemented.

DESCRIPTION OF REFERENCE NUMERALS

100 Hydraulic device
102 Oil tank
104 Supply pump
106 Accumulator
108 Auxiliary pump
110 Check valve
120 Filter part
121 Introduction part
122 Introduction inlet
123 Casing
124 Filter element
124*a* Mesh opening
125 Clearance part
126 Filter core part
126*a* Wall surface
127 Oil channel
128 Filter pore
129 Support part
130 High-pressure-side relief valve
140 Low-pressure-side relief valve
L1 High-pressure oil channel
L2 Low-pressure oil channel

The invention claimed is:

1. A hydraulic device for supplying high-pressure oil and low-pressure oil from an oil tank via a supply pump, the hydraulic device comprising:

a high-pressure oil channel configured to supply the high-pressure oil, the high-pressure oil being working oil used in hydraulic control;

a low-pressure oil channel configured to supply the low-pressure oil, the low-pressure oil to be used as lubricant oil; and an accumulator capable of accumulating a hydraulic pressure of the oil supplied to the high-pressure oil channel from the supply pump, wherein the high-pressure oil channel includes:

a filter part disposed between a connection point at which the high-pressure oil channel connects to the accumulator and a branch point of the low-pressure oil channel from the high-pressure oil channel, along a direction in which the oil is supplied; and a check valve which prevents breakage of the filter part, the check valve being disposed between the filter part and the connection point, and wherein the low-pressure oil channel includes:

a check valve capable of preventing a backflow of the oil supplied to the low-pressure oil channel; and a hydraulic-pressure adjustment valve disposed at a downstream side of the check valve and configured to adjust the hydraulic pressure of the oil.

2. The hydraulic device according to claim 1, wherein the filter part includes:

an introduction part for introducing the oil supplied from the supply pump;

a filter element having a mesh shape capable of filtering the oil introduced from the introduction part;

a filter core part which is formed from a hard material in a substantially cylindrical shape and which includes a wall surface surrounded by the filter element, the wall surface including filter pores larger in size than mesh openings of the filter element; and a discharge part connected to an inside of the filter core part, the discharge part being capable of discharging the oil filtered by the filter element.

3. The hydraulic device according to claim 1, wherein the high-pressure oil channel includes a high-pressure-side relief valve configured to be opened if a hydraulic pressure of the high-pressure oil channel is a predetermined value or more, wherein the low-pressure oil channel includes a low-pressure-side relief valve configured to be opened if a hydraulic pressure of the low-pressure oil channel is a predetermined value or more, and wherein a relief side of each of the high-pressure-side relief valve and the low-pressure-side relief valve is connected to the oil tank.

4. A prime mover device comprising a control device including the hydraulic device according to claim 1.

* * * * *